US007556172B2

(12) United States Patent
Lane

(10) Patent No.: US 7,556,172 B2
(45) Date of Patent: Jul. 7, 2009

(54) SPILL RESISTANT LID ASSEMBLY FOR A DRINK CONTAINER

(75) Inventor: Marvin Lane, Round Lake Beach, IL (US)

(73) Assignee: Thermos, L.L.C., Rolling Meadows, IL (US)

( * ) Notice: Subject to any disclaimer, the term of this patent is extended or adjusted under 35 U.S.C. 154(b) by 212 days.

(21) Appl. No.: 11/607,510

(22) Filed: Nov. 30, 2006

(65) Prior Publication Data

US 2008/0128438 A1 Jun. 5, 2008

(51) Int. Cl.
*A47G 19/22* (2006.01)

(52) U.S. Cl. ..... 220/714; 220/717; 220/711; 220/705; 215/11.5; 215/270

(58) Field of Classification Search ..... 220/717, 220/711, 705, 714, 203.1; 215/11.5, 270
See application file for complete search history.

(56) References Cited

U.S. PATENT DOCUMENTS

| | | | | |
|---|---|---|---|---|
| 2,372,281 | A * | 3/1945 | Jordan | 215/11.5 |
| 2,584,359 | A * | 2/1952 | Miles | 215/11.4 |
| 3,874,563 | A * | 4/1975 | Schwartzman | 222/213 |
| 4,646,781 | A * | 3/1987 | McIntyre et al. | 137/512.4 |
| 5,079,013 | A | 1/1992 | Belanger | |
| 5,186,347 | A | 2/1993 | Freeman et al. | |
| 5,213,236 | A | 5/1993 | Brown et al. | |
| 5,339,995 | A | 8/1994 | Brown et al. | |
| 5,377,877 | A | 1/1995 | Brown et al. | |
| 5,409,144 | A | 4/1995 | Brown | |
| 5,439,143 | A | 8/1995 | Brown et al. | |
| 5,465,866 | A | 11/1995 | Belcastro | |
| 5,542,670 | A * | 8/1996 | Morano | 220/714 |
| 5,607,073 | A * | 3/1997 | Forrer | 215/11.4 |
| D397,906 | S | 9/1998 | Briggs et al. | |
| 5,890,620 | A * | 4/1999 | Belcastro | 220/714 |
| 5,890,621 | A * | 4/1999 | Bachman et al. | 220/717 |
| 6,050,445 | A * | 4/2000 | Manganiello | 220/714 |
| 6,102,245 | A * | 8/2000 | Haberman | 220/714 |
| 6,112,919 | A * | 9/2000 | Ho | 215/11.4 |
| 6,269,968 | B1 * | 8/2001 | Belcastro | 220/714 |
| 6,357,620 | B1 * | 3/2002 | Hakim | 220/714 |
| 6,422,415 | B1 * | 7/2002 | Manganiello | 220/714 |
| D461,361 | S | 8/2002 | Orr et al. | |
| 6,508,379 | B1 * | 1/2003 | Van De Pol-Klein Nagelvoort et al. | 220/714 |
| 6,513,379 | B2 | 2/2003 | Meyers et al. | |
| 6,568,557 | B2 * | 5/2003 | Fusco et al. | 220/714 |
| 6,607,092 | B2 * | 8/2003 | Manganiello et al. | 220/714 |
| 6,732,882 | B2 * | 5/2004 | Belcastro | 220/714 |
| 6,745,915 | B2 * | 6/2004 | Rees | 220/714 |
| 6,758,364 | B1 * | 7/2004 | Röhrig | 220/714 |

(Continued)

*Primary Examiner*—Anthony D Stashick
*Assistant Examiner*—Christopher B McKinley
(74) *Attorney, Agent, or Firm*—Wood, Phillips, Katz, Clark & Mortimer

(57) ABSTRACT

A spill resistant lid assembly (10) is provided for closing the open top (12) of a drink container (14). The lid assembly (10) includes a spout housing (16), a valve plate (18), a resilient valve seal (20), and an attachment cover (22). The valve seal (20) includes an inlet diaphragm (96) and an outlet diaphragm (104) that cooperate with a pair of valve posts (46,72) to resist leakage of a beverage from the drink container (12) while allowing a flow of beverage from the drink container (14) when a user applies suction to an outlet port (42).

30 Claims, 7 Drawing Sheets

U.S. PATENT DOCUMENTS

| | | | | |
|---|---|---|---|---|
| 6,786,352 | B2 * | 9/2004 | Belcastro | 220/714 |
| RE38,692 | E * | 2/2005 | Wong | 220/713 |
| 6,923,337 | B2 * | 8/2005 | Hession et al. | 220/714 |
| 7,070,065 | B2 * | 7/2006 | Wong | 220/714 |
| 7,243,814 | B2 * | 7/2007 | Hakim | 220/714 |
| 2001/0035420 | A1 | 11/2001 | Fusco et al. | |
| 2001/0042755 | A1 * | 11/2001 | Belcastro | 220/714 |
| 2002/0066741 | A1 * | 6/2002 | Rees | 220/714 |
| 2002/0158075 | A1 * | 10/2002 | Caldicott et al. | 220/714 |
| 2005/0205589 | A1 | 9/2005 | Davis et al. | |

* cited by examiner

SPILL RESISTANT LID ASSEMBLY FOR A DRINK CONTAINER

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to so-called "sippy cup lids" for drink containers wherein the lid resists or prevents spilling from the drink container.

BACKGROUND OF THE INVENTION

Spill resistant lids, often referred to a sippy cup lids, are known and are particularly useful for drinking cups used by infants. While there are many known forms of such lids and cups, some of the known forms that provide the best resistance to spills or leaks are also the most complicated and/or hardest to clean and/or the most expensive. Accordingly, there is always room for improvement.

SUMMARY OF THE INVENTION

In accordance with one feature of the invention, a spill resistant lid assembly is provided for closing the open top of a drink container. The lid assembly includes a spout housing, a valve plate, and a resilient valve seal.

According to one feature, the spout housing includes an outlet port to deliver fluid to a user of the drink container, a first nipple extending from an interior side of the spout housing, and an inlet port to allow a replacement air flow into the drink container. The inlet port extends from an exterior side of the spout housing to a location on the interior side of the spout housing adjacent the first nipple. The valve plate includes a base, a second nipple extending from the base and positioned in the outlet port, and an opening in the base, with the first nipple extending into the opening. The resilient valve seal is sandwiched between the valve plate and the spout housing. The valve seal includes an outlet diaphragm positioned in the outlet port, an outlet opening centered in the outlet diaphragm and closed by the second nipple with the outlet diaphragm in a first position, an inlet diaphragm on a side of the valve seal opposite the spout housing, and an inlet opening centered in the inlet diaphragm. The inlet opening is closed by the first nipple with the inlet diaphragm in a first state, and the first and second diaphragms are deformed from their first positions to disengage the inlet and outlet openings from the first and second nipples in response to a reduction of pressure in the outlet port.

As one feature, the outlet port includes a cylindrical opening, the valve seal includes a cylindrical wall extending into the cylindrical opening and supporting the outlet diaphragm, and the outlet nipple is located on a post extending from the base into the cylindrical opening, with the post being surrounded by the cylindrical wall.

As a further feature, the valve plate includes an outwardly extending, annular lip surrounding the post, with the lip engaging an interior side of the cylindrical wall of the valve seal to retain the valve seal to the valve plate.

According to one feature, there is at least one flow opening located between the post and the annular lip.

In one feature, the annular lip is sized to force the cylindrical wall of the valve seal into a frictional engagement with the cylindrical opening to retain the valve plate and valve seal to the spout housing.

In accordance with one feature, the spout housing includes a cylindrical post extending into the opening of the valve plate and supporting the first nipple, the inlet port includes at least one opening formed in the cylindrical post, and the valve seal includes a cylindrical wall supporting the inlet diaphragm and surrounding the cylindrical post. As a further feature, the cylindrical wall includes an outwardly extending, annular lip engaged with the base of the valve plate to retain the valve seal to the valve plate. In yet a further feature, the cylindrical post and the cylindrical wall are frictionally engaged to retain the valve seal and the valve plate to the spout housing.

According to one feature, the interior side of the spout housing is a planar surface that is interrupted only by the outlet port, the inlet port, the first nipple, and a cylindrical wall supporting the first nipple.

In accordance with one feature of the invention, the spout housing includes a planar surface sized to cover the open top of the drink container, an outlet port extending between the planar surface and an exterior of the spout housing to deliver fluid to a user of the drink container, a first valve post extending from the planar surface, and an inlet port extending between the exterior and the first valve post to allow a replacement air flow into the drink container. The valve plate includes a first planar base, a second valve post extending from the base and positioned in the outlet port, and an opening in the base, with the first valve post extending into the opening. The resilient valve seal includes a second planar base sandwiched between the first planar base and the planar surface, a first resilient portion extending from the second planar base into the opening and engaged with the first valve post, and a second resilient portion extending from the second planar base into the outlet port and engaged with the second valve post.

In one feature, the first valve post includes a first nipple, and the first resilient portion includes an inlet diaphragm, and an inlet opening centered in the inlet diaphragm, with the inlet opening being closed by the first nipple with the inlet diaphragm in a first position and the first diaphragm being deformed from the first position to disengage the inlet opening from first nipple in response to a reduction of pressure in the outlet port.

As one feature, the second valve post includes a second nipple; and the second resilient portion includes an outlet diaphragm positioned in the outlet port, and an outlet opening centered in the outlet diaphragm and closed by the second nipple with the outlet diaphragm in a first position. The second diaphragm is deformed from the first position to disengage the outlet opening from the second nipple in response to a reduction of pressure in the outlet port.

According to one feature, the outlet port includes a cylindrical opening, and the second resilient portion includes a cylindrical wall extending into the cylindrical opening. As a further feature, the valve plate includes an outwardly extending, annular lip surrounding the second valve post, the lip engaging an interior side of the cylindrical wall of the valve seal to retain the valve seal to the valve plate. In yet a further feature, there is at least one flow opening located between the post and the annular lip. In one further feature, the annular lip is sized to force the cylindrical wall of the valve seal into a frictional engagement with the cylindrical opening to retain the valve plate and valve seal to the spout housing.

As one feature, the first resilient portion includes a cylindrical wall surrounding the first valve post. As a further feature, the cylindrical wall includes an outwardly extending, annular lip engaged with the first planar base to retain the valve seal to the valve plate. In yet a further feature, the first valve post and the cylindrical wall are frictionally engaged to retain the valve seal and the valve plate to the spout housing.

According to one feature, the lid assembly further includes a lid cover sized to receive the spout housing and including a flange for retaining the lid assembly to the drink container.

Other objects, features, and advantages of the invention will become apparent from a review of the entire specification, including the appended claims and drawings.

DETAILED DESCRIPTION OF THE PREFERRED EMBODIMENT

Figure 1:
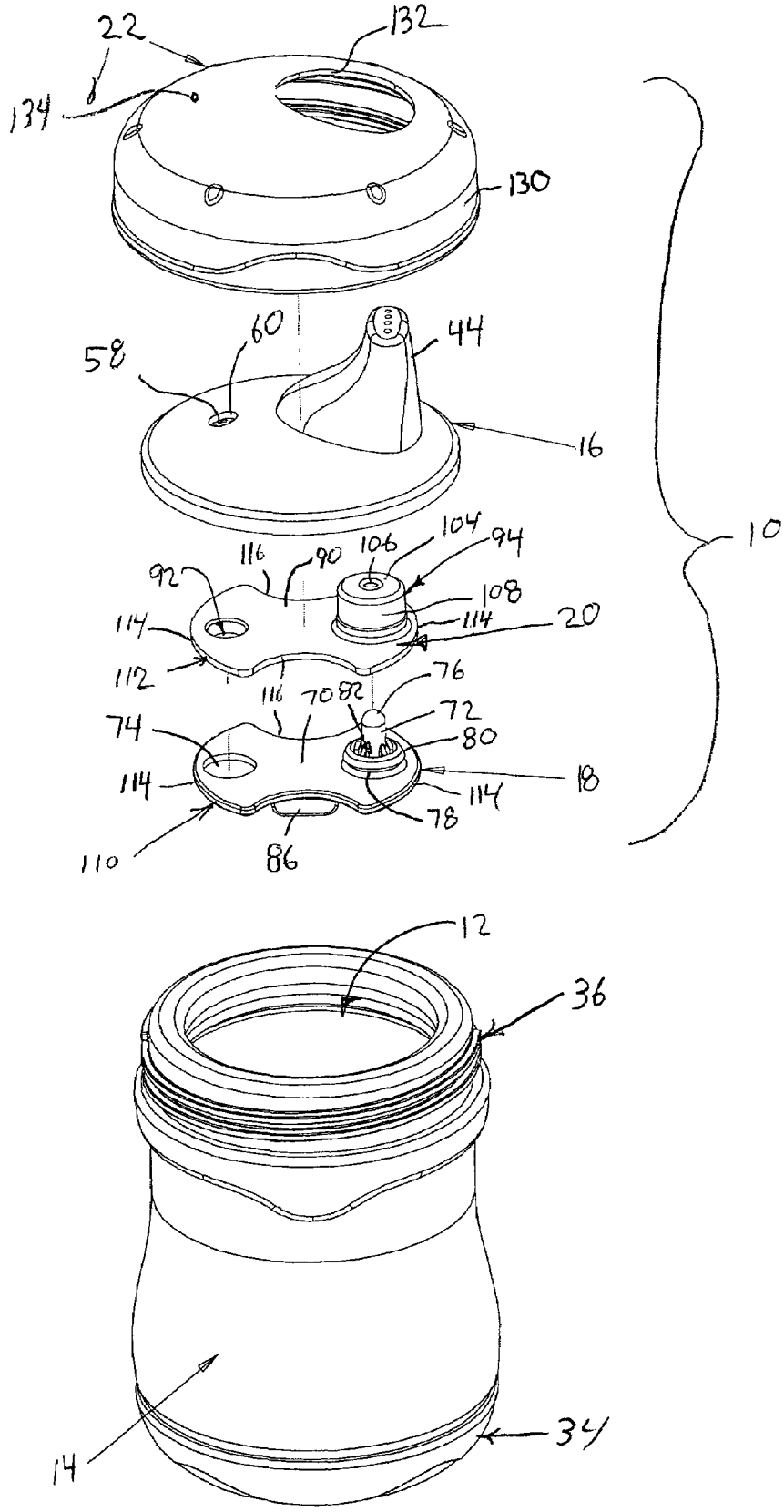
FIG. 1 is an exploded perspective view of a drink container and spill resistant lid assembly embodying the present invention.

With reference to FIG. 1, a spill resistant lid assembly 10 is provided for closing the open top 12 of a drink container 14. The lid assembly 10 includes a spout housing 16, a valve plate 18, a resilient valve seal 20, and an attachment cover 22.

Figure 2:
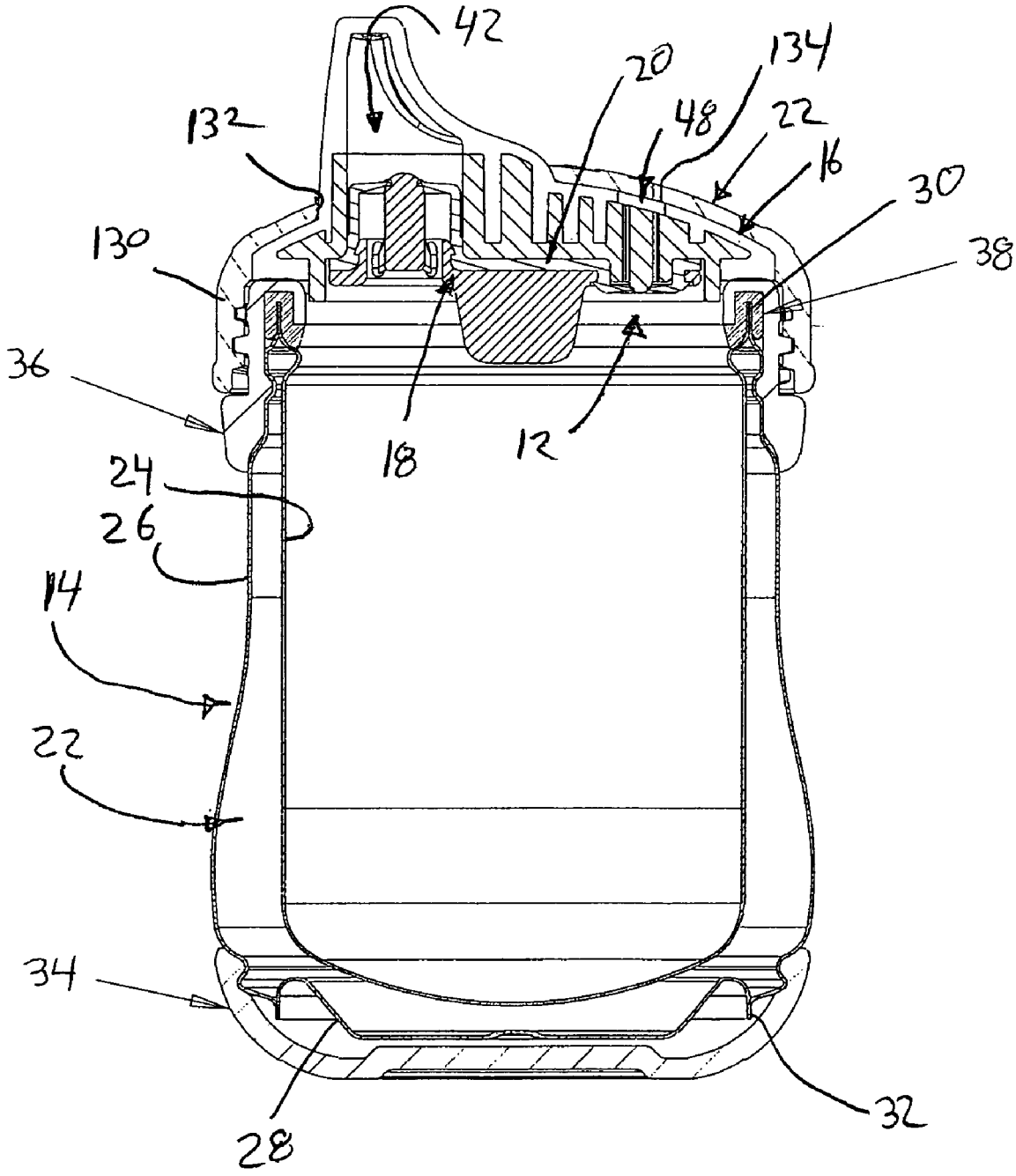
FIG. 2 is a section view of the drink container and lid assembly of FIG. 1 shown in their assembled state.

While any suitable drink container can be used, in the illustrated embodiment, the drink container 14 is a thermally insulated container with an insulation space 22 provided between an inner liner 24 and an outer liner 26 and a bottom piece 28, as best seen in FIG. 2. The upper end of the inner liner 24 is bonded, such as by brazing or welding, to the upper end of the outer liner 26 at mating cylindrical flanges 30. The outer liner 26 includes the bottom piece 28 that is bonded to the remainder of the outer liner 26 at mating cylindrical flanges 32. A base 34 covers the bottom 28 and a threaded seal shoulder 36 is provided at the top of the liners 24 and 26, with an annular seal member 38 provided between the flanges 30 and the seal shoulder 36. The liners 24 and 26 are preferably made from a suitable metal, such as stainless steel, and the base 34 and shoulder 36 are preferably made from a suitable polymer material.

Figure 3A:
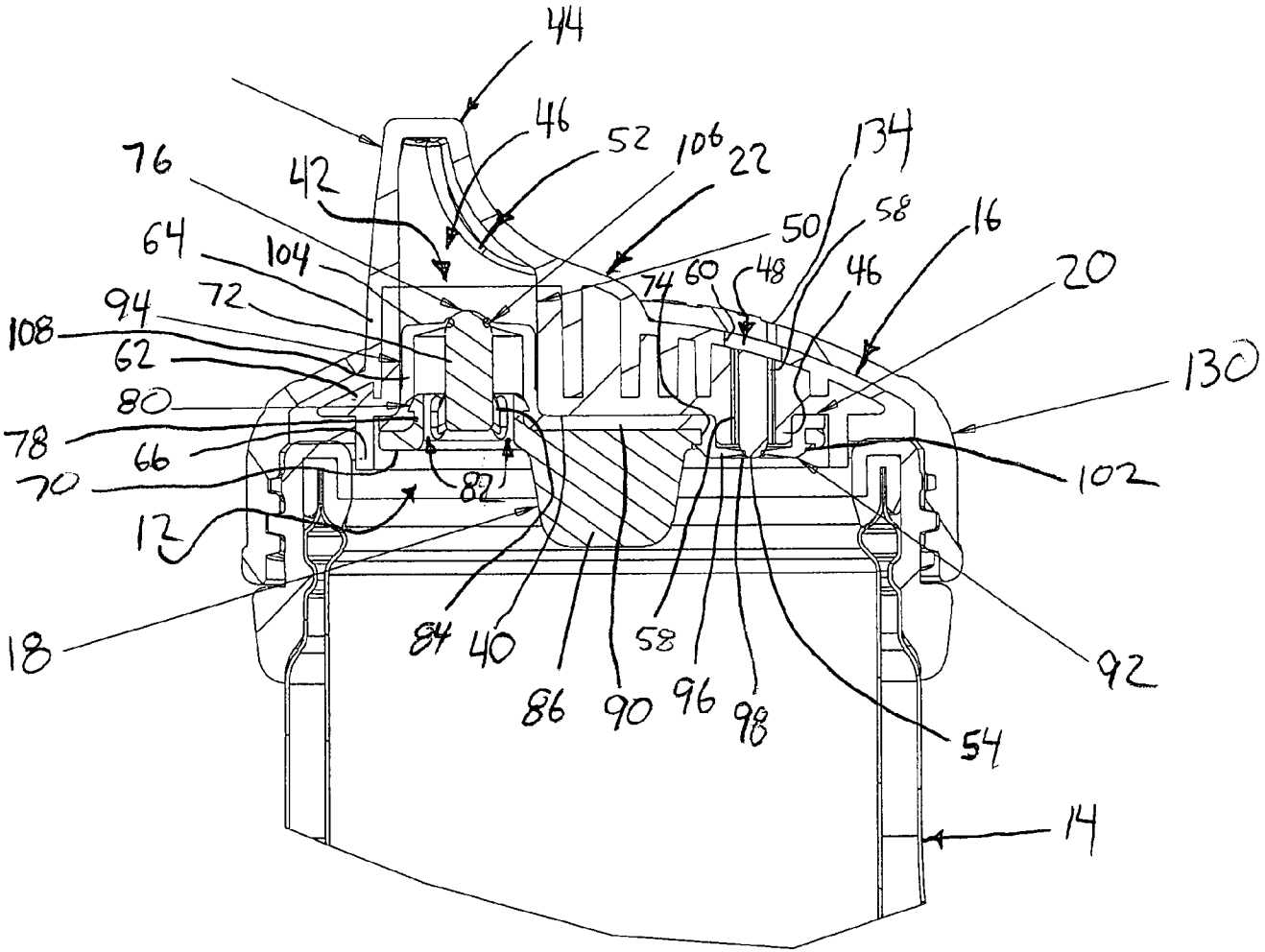
FIG. 3A and 3B are enlarged views of a portion of FIG. 2, with FIG. 3A showing the spill resistant lid in a first or sealed state, and FIG. 3B showing the spill resistant lid in a second or flowing state.
Figure 3B:
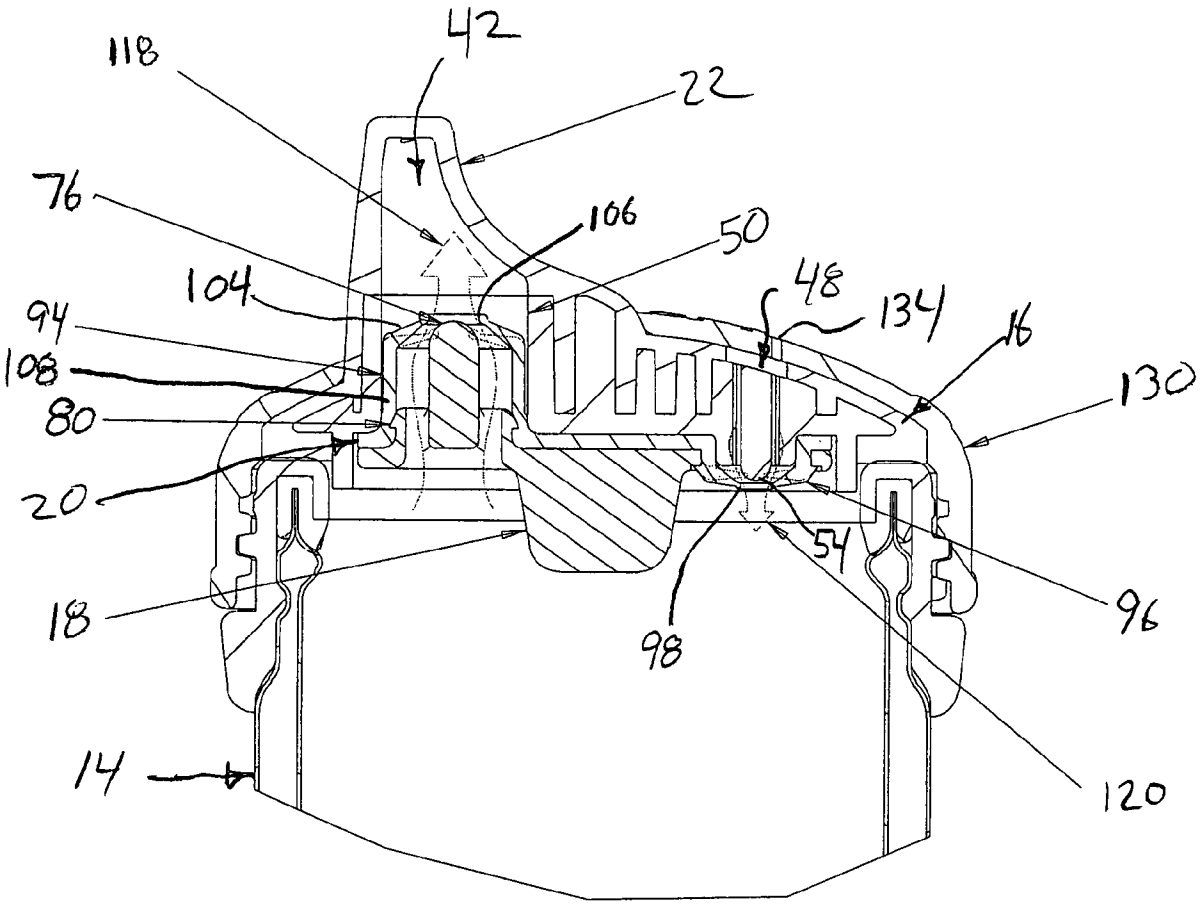
Figure 4:
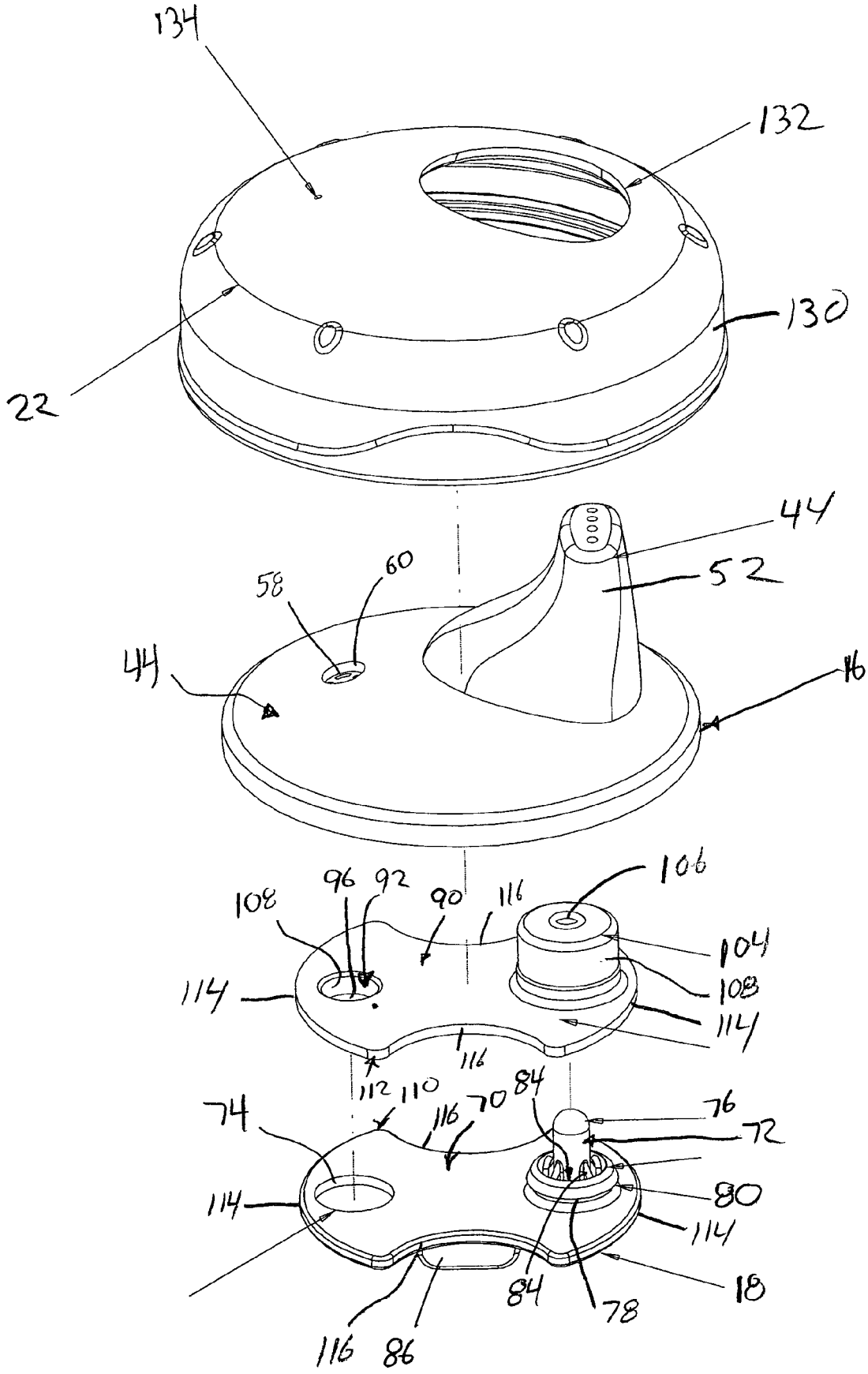
FIG. 4 is an exploded perspective view from above of the spill proof lid assembly of FIGS. 1-3B.
Figure 5:
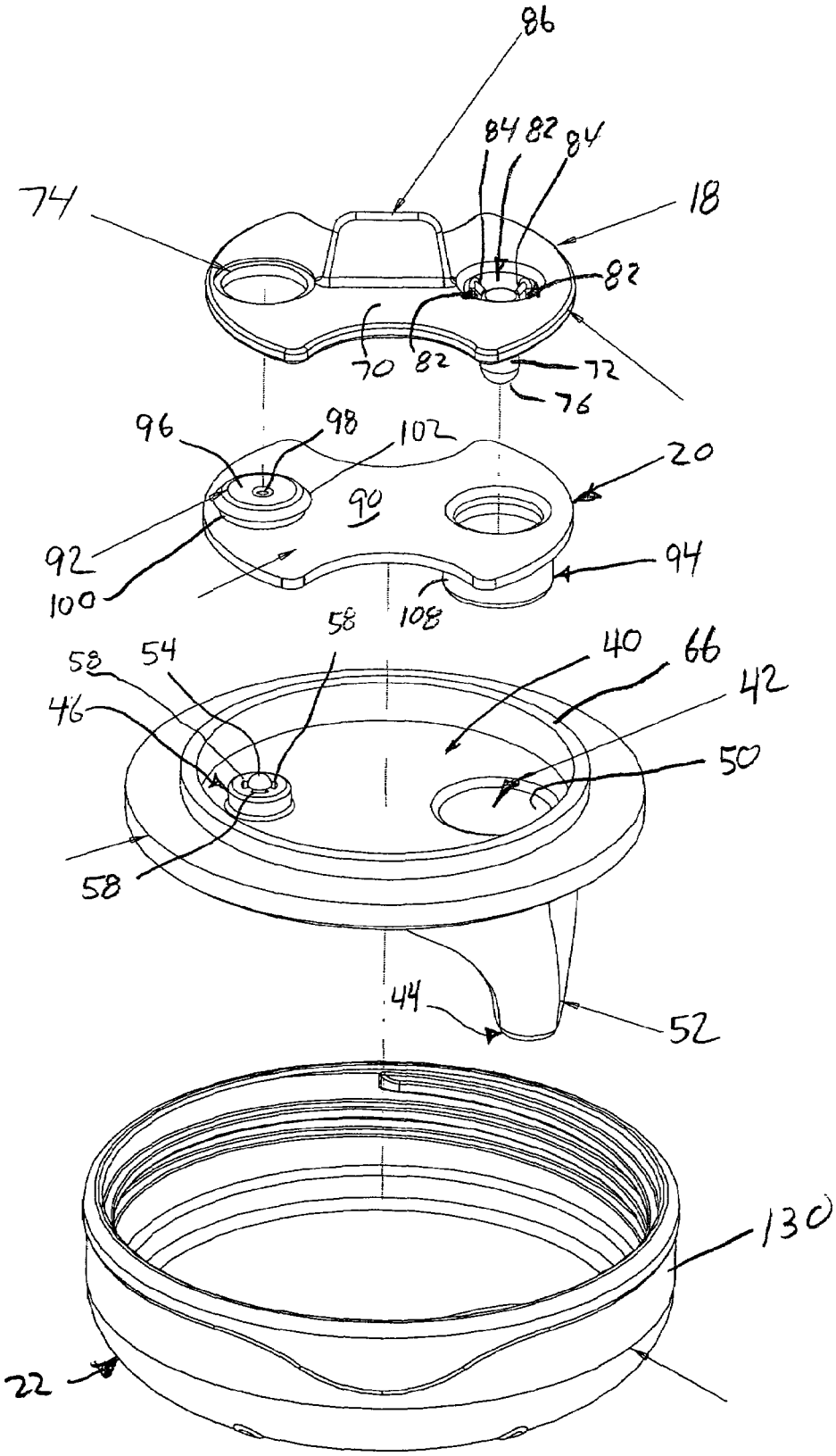
FIG. 5 is an exploded perspective view from below of the spill resistant lid assembly of FIGS. 1-4.

As best seen in FIGS. 3A, 3B and 5, the spout housing 16 includes a planar inner surface 40 sized to overlay the open top 12 of the drink container 14, an outlet port, shown generally at 42, extending between the planar surface 40 and an exterior 44 of the spout housing 16 to deliver fluid to a user of the drink container 14, an inlet valve post 46 extending from the planar surface 40, and an inlet port, shown generally at 48, extending between the exterior 44 and the inlet valve post 46 to allow a replacement air flow into the drink container 14. The outlet port 42 includes a cylindrical opening 50 extending upward from the surface 40 to a spout 52. The inlet valve post 46 is preferably cylindrical and includes a semi-spherical shaped inlet valve seat or nipple 54 centered on the end 56 of the post 46. As best seen in FIGS. 4 and 5, the inlet port 48 preferably includes four somewhat rectangular shaped slots 58 that extend from the post 46 to a cylindrical opening 60 in the exterior 44. While not required, as best seen in FIGS. 3A and 3B, the spout housing in the illustrated embodiment is formed from an over-mold process that utilizes two pieces 62 and 64. In this regard, the surface 40 is preferably surrounded by an annular flange 66 that is originally formed in the piece 62 to limit the over molding of the piece 64, with the flange 66 being sized to fit within the open top 12.

Figure 6:
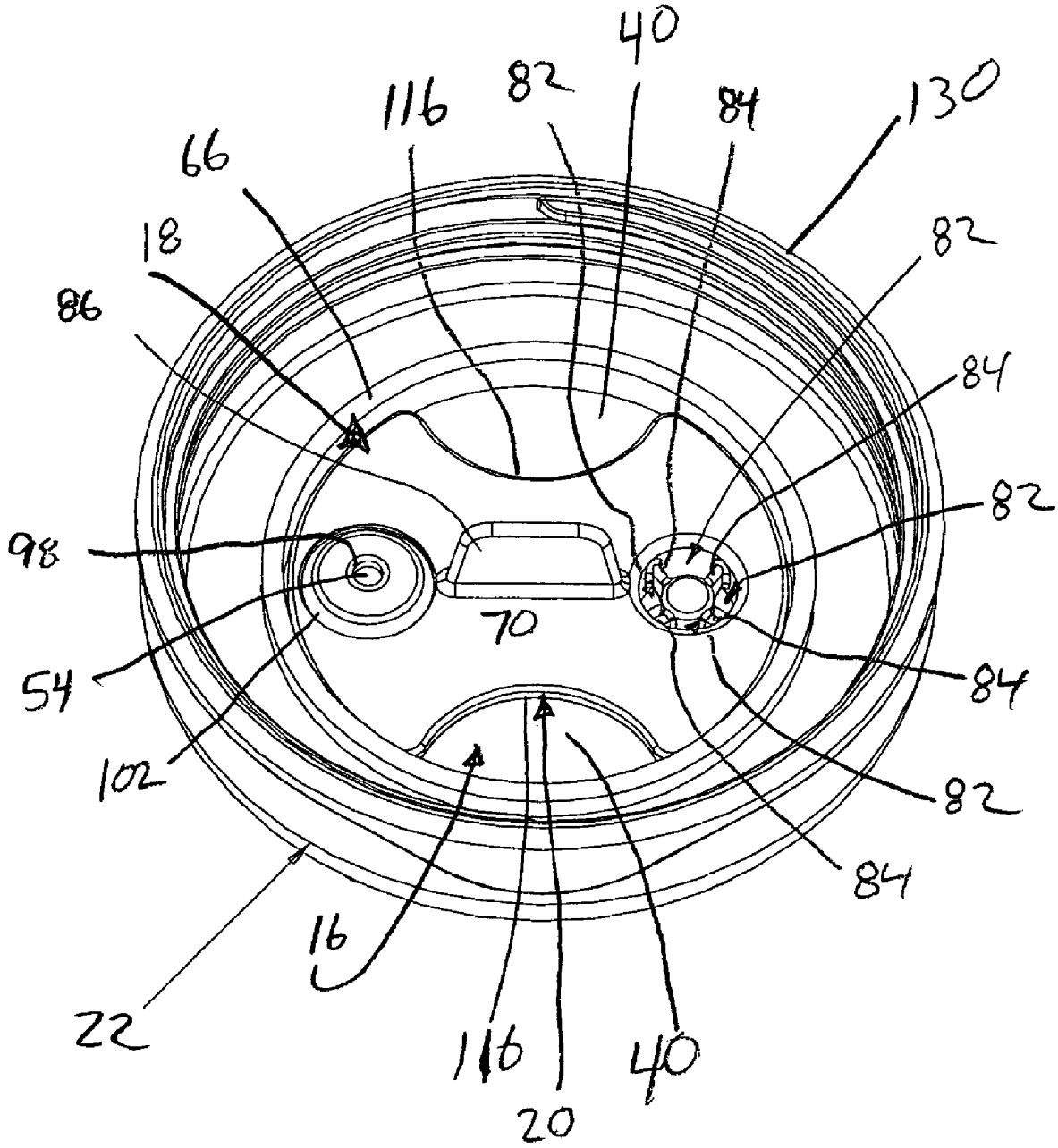
FIG. 6 is a perspective view from below showing the spill resistant lid in an assembled state.

As best seen in FIG. 4, the valve plate 18 includes a planar base 70, an outlet valve post 72 extending from the base 70 and positioned in the cylindrical opening 50 of the outlet port 42, and an opening 74 in the base 70. The outlet valve post 72 is preferably cylindrical and includes a semi-spherical shaped outlet valve seat or nipple 76 on the end of the post 72. The valve plate 18 preferably includes a short cylindrical wall 78 with an outwardly extending, annular lip 80 surrounding the post 72. As best seen in FIG. 6, four flow openings 82 are provided between the post 72 and the cylindrical wall 78. The flow openings 82 define four spokes 84 that connect the post 72 to the wall 78. Preferably, a tab or fin 86 extends from the base 70 on the interior side of the assembly 10. The tab 86 can be gripped by the fingers of a user to assist the user in disassembling the valve plate 18 and the valve seal 20 from the spout housing 16.

The resilient valve seal 20 includes a planar base 90 sandwiched between the planar base 70 of the valve plate 18 and the planar surface 40 of the spout housing 16. The valve seal 20 also includes a resilient portion 92 extending from the planar base 90 into the opening 74 and engaged with the inlet valve post 46, and a another resilient portion 94 extending from the planar base 90 into the cylindrical opening 50 of the outlet port 42 and engaged with the outlet valve post 72. As best seen in FIG. 5, the resilient portion 92 includes an inlet diaphragm 96, an inlet opening 98 centered in the inlet diaphragm 96, and a cylindrical wall 100 connecting the inlet diaphragm 96 to the base 90. The cylindrical wall 100 includes an outwardly extending, annular lip 102. As best seen in FIG. 4, the resilient portion 94 includes an outlet diaphragm 104, an outlet opening 106 centered in the outlet diaphragm 104, and a cylindrical wall 108 connecting the outlet diaphragm 104 to the base 90.

Preferably, the planar bases 70 and 90 of the valve plate and seal 18 and 20 have matching outer peripheries 110 and 112, respectively, with opposite ends 114 that conform to the annular flange 66 of the spout housing 16 and opposite sides 116 that have a convex shape that is spaced from the flange 66 to allow the valve plate and seal 18 and 20 to be gripped by a user for removal from the spout housing 16.

As best seen in FIG. 3A, in the assembled state, the inlet opening 98 is engaged with the inlet nipple 54 and the outlet opening 106 is engaged with the outlet nipple 76, with both the diaphragms 96 and 104 being placed in sufficient tension to seal the openings 98 and 106 closed against their respective nipples 54 and 106. As best seen in FIG. 3B, when the pressure in the outlet port 42 is reduced by a user placing suction on the spout 52, the outlet diaphragm 104 deforms away from the nipple 106 to allow a flow 118 of the beverage through the outlet port 42 from the drink container 14 to the user. Similarly, as the beverage flows from the drink container 14, the pressure inside the container 14 is reduced and the inlet diaphragm 96 deforms away from the nipple 54 to allow a replacement flow 120 of air through the inlet port 48 from the exterior to the inside of the drink container 14.

As best seen in FIGS. 3A and 3B, to releasably retain the valve plate and seal 18 and 20 in the assembled state, the annular lip 80 engages against the cylindrical wall 108 and the annular lip 102 engages against the base 70 adjacent the opening 74. To releasably retain the valve plate and seal 18 and 20 to the spout housing 16, the cylindrical wall 100 frictionally engages or "grips" the outer surface of the inlet valve post 46, and the annular lip 80 is sized to force the cylindrical wall 108 into a frictional engagement with the cylindrical opening 50.

The attachment cover 22 is sized to receive the spout housing 16 and includes a flange 130 for retaining the lid assembly 10 to the drink container 14, an opening 132 that is sized to receive the exterior of the spout 52 of the outlet port 42, and an opening 134 that allows the flow 120 of replacement air to the inlet port 48. The flange 132 includes threads to engage the threads on the seal shoulder 36 for a sealed attachment of the lid assembly 10 to the drink container 14.

It should be appreciated that while preferred embodiments of the lid assembly 10 have been shown, there are many possible variations that lie within the scope of the invention. For example, in some applications it may be desirable for the attachment cover 22 to be integrated as part of the spout housing 16, rather than as a separate piece as shown. As another example, in some applications it may be desirable for the attachment between the lid assembly 10 and the drink container 14 to a snap connection, rather than a threaded connection. As yet another example, while the spout housing 16 has been shown as an overmold type construction having two pieces, in some applications it may be desirable to form the spout housing from one piece, or from more than two pieces. As yet another example, while the planar surface 40 and the planar bases 70 and 90 provide certain advantages for assembling and cleaning, in some applications it may be desirable for one or more of these features to be nonplanar. As a further example, while the lid assembly 10 has been shown in connection with an insulated drink container 14, it could just as easily be applied to a non-insulated drink container of a simpler construction.

It should be appreciated that the spout housing 16, valve plate 18 and valve seal 20 can provide a relatively simple, low cost construction for a sippy lid that is also highly functional. Furthermore, it should be appreciated that the planar surface 40 of the spout housing 16 which is interrupted only by cylindrical opening 50 for the outlet port 42 and by the valve post 46, can reduce the possibility of retaining residue from the beverages contained in the drink container 14, thereby simplifying the cleaning procedures for the lid assembly 10. In this regard, it should also be appreciated that the snap/frictional engagement of the components 16,18 and 20 allows for easy assembly and disassembly, which also can simplify the cleaning of the lid assembly 10.

The invention claimed is:

1. A spill resistant lid assembly for closing the open top of a drink container, the lid assembly comprising:

a spout housing including an outlet port to deliver fluid to a user of the drink container, a first nipple extending from an interior side of the spout housing, and an inlet port to allow a replacement air flow into the drink container, the inlet port extending from an exterior side of the spout housing to a location on the interior side of the spout housing adjacent the first nipple;

a valve plate including a base, a second nipple extending from the base and positioned in the outlet port, and an opening in the base, the first nipple extending into the opening; and a resilient valve seal sandwiched between the valve plate and the spout housing, the valve seal including an outlet diaphragm positioned in the outlet port, an outlet opening centered in the outlet diaphragm and closed by the second nipple with the outlet diaphragm in a first position, an inlet diaphragm on a side of the valve seal opposite the spout housing, and an inlet opening centered in the inlet diaphragm, the inlet opening closed by the first nipple with the inlet diaphragm in a first position, the outlet and inlet diaphragms being deformed from their first positions to disengage the inlet and outlet openings from the first and second nipples in response to a reduction of pressure in the outlet port.

2. The lid assembly of claim 1 wherein the outlet port includes a cylindrical opening, the valve seal includes a cylindrical wall extending into the cylindrical opening and supporting the outlet diaphragm, and the outlet nipple is located on a post extending from the base into the cylindrical opening, the post surrounded by the cylindrical wall.

3. The lid assembly of claim 2 wherein the valve plate includes an outwardly extending, annular lip surrounding the post, the lip engaging an interior side of the cylindrical wall of the valve seal to retain the valve seal to the valve plate.

4. The lid assembly of claim 3 including at least one flow opening located between the post and the annular lip.

5. The lid assembly of claim 3 wherein the annular lip is sized to force the cylindrical wall of the valve seal into a frictional engagement with the cylindrical opening to retain the valve plate and valve seal to the spout housing.

6. The lid assembly of claim 1 wherein the spout housing includes a cylindrical post extending into the opening of the valve plate and supporting the first nipple, the inlet port includes at least one opening formed in the cylindrical post, and the valve seal includes a cylindrical wall supporting the inlet diaphragm and surrounding the cylindrical post.

7. The lid assembly of claim 6 wherein the cylindrical wall includes an outwardly extending, annular lip engaged with the base to retain the valve seal to the valve plate.

8. The lid assembly of claim 7 wherein the cylindrical post and the cylindrical wall are frictionally engaged to retain the valve seal and the valve plate to the spout housing.

9. The lid assembly of claim 1 wherein the interior side of the spout housing is a planar surface that is interrupted only by the outlet port, the inlet port, the first nipple, and a cylindrical wall supporting the first nipple.

10. A spill resistant lid assembly for closing an open top of a drink container, the lid assembly comprising:

a spout housing including a planar surface, an outlet port extending between the planar surface and an exterior of the spout housing to deliver fluid to a user of the drink container, a first valve post extending from the planar surface, and an inlet port extending between the exterior and the first valve post to allow a replacement air flow into the drink container;

a valve plate including a first planar base, a second valve post extending from the base and positioned in the outlet port, and an opening in the base, the first valve post extending into the opening; and a resilient valve seal including a second planar base sandwiched between the first planar base and the planar surface, a first resilient portion extending from the second planar base into the opening and engaged with the first valve post, and a second resilient portion extending from the second planar base into the outlet port and engaged with the second valve post.

11. The lid assembly of claim 10 wherein:

the first valve post includes a first nipple; and the first resilient portion includes an inlet diaphragm, and an inlet opening centered in the inlet diaphragm, the inlet opening closed by the first nipple with the inlet diaphragm in a first state, the first diaphragm being deformed from the first position to disengage the inlet opening from the first nipple in response to a reduction of pressure in the outlet port.

12. The lid assembly of claim 10 wherein:

the second valve post includes a second nipple; and the second resilient portion includes an outlet diaphragm positioned in the outlet port, and an outlet opening centered in the outlet diaphragm and closed by the second nipple with the outlet diaphragm in a first position, the second diaphragm being deformed from the first position to disengage the outlet opening from the second nipple in response to a reduction of pressure in the outlet port.

13. The lid assembly of claim 10 wherein the outlet port includes a cylindrical opening, and the second resilient portion includes a cylindrical wall extending into the cylindrical opening.

14. The lid assembly of claim 13 wherein the valve plate includes an outwardly extending, annular lip surrounding the second valve post, the lip engaging an interior side of the cylindrical wall of the valve seal to retain the valve seal to the valve plate.

15. The lid assembly of claim 14 including at least one flow opening located between the post and the annular lip.

16. The lid assembly of claim 14 wherein the annular lip is sized to force the cylindrical wall of the valve seal into a frictional engagement with the cylindrical opening to retain the valve plate and valve seal to the spout housing.

17. The lid assembly of claim 10 wherein the first resilient portion includes a cylindrical wall surrounding the first valve post.

18. The lid assembly of claim 17 wherein the cylindrical wall includes an outwardly extending, annular lip engaged with the first planar base to retain the valve seal to the valve plate.

19. The lid assembly of claim 18 wherein the first valve post and the cylindrical wall are frictionally engaged to retain the valve seal and the valve plate to the spout housing.

20. The lid assembly of claim 10 further comprising a lid cover sized to receive the spout housing and including a flange for retaining the lid assembly to the drink container.

21. A spill resistant lid assembly for closing the open top of a drink container and having an outlet port to deliver fluid to a user of the drink container, the lid assembly comprising:

an outer housing including a first nipple extending from an interior side of the outer housing, and an inlet port to allow a replacement air flow into the drink container, the inlet port extending from an exterior side of the outer housing to a location on the interior side of the outer housing adjacent the first nipple;

a valve plate including a base, a second nipple extending from the base and positioned in the outlet port, and an opening in the base, the first nipple extending into the opening;

a resilient outlet diaphragm positioned in the outlet port and having an outlet opening centered in the outlet diaphragm and closed by the second nipple with the outlet diaphragm in a first position; and a resilient inlet diaphragm having an inlet opening centered in the inlet diaphragm, the inlet opening closed by the first nipple with the inlet diaphragm in a first position, the first and second diaphragms being deformable from their first positions to second positions with the inlet and outlet openings disengaged from the first and second nipples.

22. The lid assembly of claim 21 wherein the outer housing comprises the outlet port.

23. The lid assembly of claim 21 wherein the outlet diaphragm and the inlet diaphragm are part of a resilient valve seal sandwiched between the valve plate and the outer housing.

24. The lid assembly of claim 21 wherein the outlet port includes a cylindrical opening, the valve seal includes a cylindrical wall extending into the cylindrical opening and supporting the outlet diaphragm, and the outlet nipple is located on a post extending from the base into the cylindrical opening, the post surrounded by the cylindrical wall.

25. The lid assembly of claim 24 wherein the valve plate includes an outwardly extending, annular lip surrounding the post, the lip engaging an interior side of the cylindrical wall of the valve seal to retain the valve seal to the valve plate.

26. The lid assembly of claim 25 including at least one flow opening located between the post and the annular lip.

27. The lid assembly of claim 25 wherein the annular lip is sized to force the cylindrical wall of the valve seal into a frictional engagement with the cylindrical opening to retain the valve plate and valve seal to the spout housing.

28. The lid assembly of claim 21 wherein the spout housing includes a cylindrical post extending into the opening of the valve plate and supporting the first nipple, the inlet port includes at least one opening formed in the cylindrical post, and the valve seal includes a cylindrical wall supporting the inlet diaphragm and surrounding the cylindrical post.

29. The lid assembly of claim 28 wherein the cylindrical wall includes an outwardly extending, annular lip engaged with the base to retain the valve seal to the valve plate.

30. The lid assembly of claim 29 wherein the cylindrical post and the cylindrical wall are frictionally engaged to retain the valve seal and the valve plate to the spout housing.

* * * * *